US006315786B1

(12) United States Patent
Smuckler

(10) Patent No.: US 6,315,786 B1
(45) Date of Patent: Nov. 13, 2001

(54) DEVICE FOR TREATING HEEL PAIN

(75) Inventor: Arthur H. Smuckler, Niskayuna, NY (US)

(73) Assignee: Partnership of Arthur H. Smuckler, James Grimes, Niko Efstathiou and Charles A. Sarris, Niskayuna, NY (US)

( * ) Notice: Subject to any disclaimer, the term of this patent is extended or adjusted under 35 U.S.C. 154(b) by 0 days.

(21) Appl. No.: 09/356,715

(22) Filed: Jul. 20, 1999

(51) Int. Cl.[7] ..... A61B 17/00
(52) U.S. Cl. ..... 606/201; 36/145; 36/154
(58) Field of Search ..... 602/61, 66; 601/134, 601/23, 27, 28; 36/88, 91, 92, 141, 145, 148, 149, 154, 180, 182, 153, 173, 171, 43, 146; 606/201, 204

(56) References Cited

U.S. PATENT DOCUMENTS

| | | | | |
|---|---|---|---|---|
| 1,497,243 | * | 6/1924 | Martin | 601/27 |
| 1,974,161 | * | 9/1934 | Riley | 36/91 |
| 3,744,483 | * | 7/1973 | Picolin | 601/28 |
| 3,885,555 | * | 5/1975 | Nobbs | 601/28 |
| 3,999,558 | * | 12/1976 | Barnwell et al. | 36/145 |
| 4,224,750 | * | 9/1980 | Delport | 36/91 |
| 4,325,380 | | 4/1982 | Malkin . | |
| 4,329,981 | * | 5/1982 | Dungl | 601/28 |
| 4,689,898 | * | 9/1987 | Fahey | 36/43 |
| 5,036,851 | | 8/1991 | Cohen . | |
| 5,067,256 | | 11/1991 | Darby . | |
| 5,088,479 | | 2/1992 | Detoro . | |
| 5,127,892 | * | 7/1992 | Sawdon | 482/79 |
| 5,154,173 | * | 10/1992 | Aultman | 36/154 |
| 5,162,041 | * | 11/1992 | Simmons | 602/65 |
| 5,184,409 | | 2/1993 | Brown . | |
| 5,203,793 | * | 4/1993 | Lyden | 36/88 |
| 5,359,791 | * | 11/1994 | Prahl et al. | 36/145 |
| 5,388,351 | * | 2/1995 | Mitchell et al. | 36/145 |
| 5,400,526 | * | 3/1995 | Sessa | 36/141 |
| 5,611,153 | | 3/1997 | Fisher et al. . | |
| 5,776,090 | | 7/1998 | Bergmann et al. . | |
| 5,799,659 | | 9/1998 | Stano . | |
| 5,865,779 | | 2/1999 | Gleason . | |
| 5,887,591 | | 3/1999 | Powell et al. . | |
| 5,893,221 | * | 4/1999 | Weissman et al. | 36/91 |
| 6,021,585 | * | 2/2000 | Cole | 36/11.5 |

OTHER PUBLICATIONS

The Foot, *Gray's Anatomy*, pp. 199–201.
Muscles and Fasciae of the Foot, *Gray's Anatomy*, pp. 442–451.

* cited by examiner

*Primary Examiner*—Justine R. Yu
(74) *Attorney, Agent, or Firm*—Knobbe, Martens, Olson & Bear LLP

(57) ABSTRACT

An orthotic device for treating heel pain associated with Plantar Fasciitis is disclosed, comprised of a flexible heel cup shoe insert with a bar-shaped member extending laterally across the bottom sole portion of the device and located under the heel-arch connection of a person's foot when worn by the person in order to apply continuous accupressure to the calcaneus-midtarsal connection area and thus alleviate pain.

4 Claims, 4 Drawing Sheets

DEVICE FOR TREATING HEEL PAIN

BACKGROUND OF THE INVENTION

1. Field of the Invention

The present invention relates to a novel orthotic device for use in relieving heel pain. In particular, the present invention relates to an orthotic device involving the continuous placement of pressure to a certain area of the foot in order to alleviate pain resulting from Plantar Fasciitis.

2. Description of the Related Art

Plantar Fasciitis is the most common cause of heel pain, debilitating countless people of both active and sedentary lifestyles. The condition is caused by overstressing and subsequent inflammation of the plantar fascia, which is the dense, fibrous sheath of muscle tissue located longitudinally on the bottom of the foot, stretching from the calcaneus bone at the rear of the foot to the metatarsal heads leading to the toes in the front of the foot. Heel spurs, which consist of calcinaceous deposits that grow on the front of the calcaneus and point into the plantar fascia, can exacerbate the pain to an unbearable extent. Patents's complaints of heel pain often originate in the first step they take out of the bed in the morning, when the plantar fascia is stretched violently out of the natural contraction that occurs during a state of sleep. This pain may ease gradually throughout the day, only to return the next morning.

Sufferers of heel pain due to Plantar Fasciitis and/or heel spur commonly seek treatment through physical therapy, corticosteroid drugs, surgical procedures, and a myriad of orthotic devices, cushions, and gels. The complexity of treating this ailment is supplemented by other biomechanical factors, such as pronation (rolling in of the feet), supination (rolling out of the feet), weakened ankles, extra body weight, improper footwear, loss of the body's natural shock absorbers, flattened or dropped arches, and weakened high arches.

The prior art includes several orthotic devices intended to treat heel pain of various types. Devices exist to hold, immobilize, and/or support the heel and/or leg of the user. Patents have been issued for inventions that involve L-shaped leg braces with various immobilization features, elastic footwraps which provide compressive forces on the bottom of the foot, and orthotic insoles to be worn with shoes for arch support and heel cushioning. The existing devices claim to alleviate heel pain by cushioning and cradling the heel, applying accupressure to various foot locations using gel platforms, and placing a softer material surrounded by a more resilient one to treat pain originating from the calcaneous. While these devices provide some temporary relief, they have not typically resulted in a pain-free experience for patients. There is, therefor, a need for a device and method of treatment which relieves the pain associated with Plantar Fasciitis to a greater extent than is provided by current treatment protocols.

SUMMARY OF THE INVENTION

The inventor's experiences as a podiatrist treating patients led to the discovery that accupressure applied at the calcaneous-midtarsal connection on the bottom of the foot temporarily alleviated the pain associated with Plantar Fasciitis. The calcaneous-midtarsal connection is the point on the bottom of the foot where the heel meets the arch. Further, the inventor discovered that accupressure continually applied to this location, using a specially constructed orthotic device, could provide the key to pain relief, as indicated by many patient trials, often resulting in a completely pain-free experience for many patients.

While standard orthotic inserts often comprise a flexible heel cup, the present invention provides heel pain relief associated with Plantar Fasciitis using a raised bar which extends above the surface of such a standard orthotic insert. This "Fasciitis bar" extends laterally across the sole portion of the cup, in a position located beneath the calcaneous-midtarsal connection of the foot when the orthotic device is worn. The flexible heel cup serves to locate the Fasciitis bar in precisely the proper location to apply moderate accupressure force when the patient walks or stands.

Made of a resilient, dense material, the Fasciitis bar provides sufficient accupressure to the calcaneous-midtarsal connection to stretch the plantar fascial tissues and prevent collapse of the calcaneal bone, thus relieving pain. The Fasciitis bar places the center of accupressure mid-way across the width of the patient's foot. This is distinct from the arch support portion of standard orthotics, which apply upward pressure against the inside of the patient's foot, further forward toward the ball of the foot. In fact, the Fasciitis bar of the present invention is located to provide pressure between the heel and the arch of the foot, along the centerline of the foot.

DETAILED DESCRIPTION OF THE PREFERRED EMBODIMENT

Figure 1:
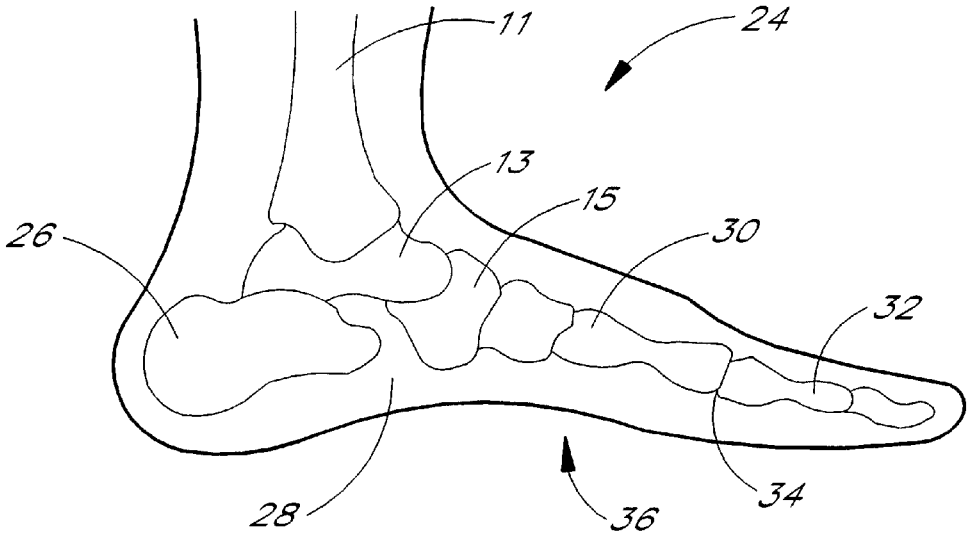
FIG. 1 is a side elevation view looking toward the inside of a human left foot, including the major bones of the foot and ankle.
Figure 2:
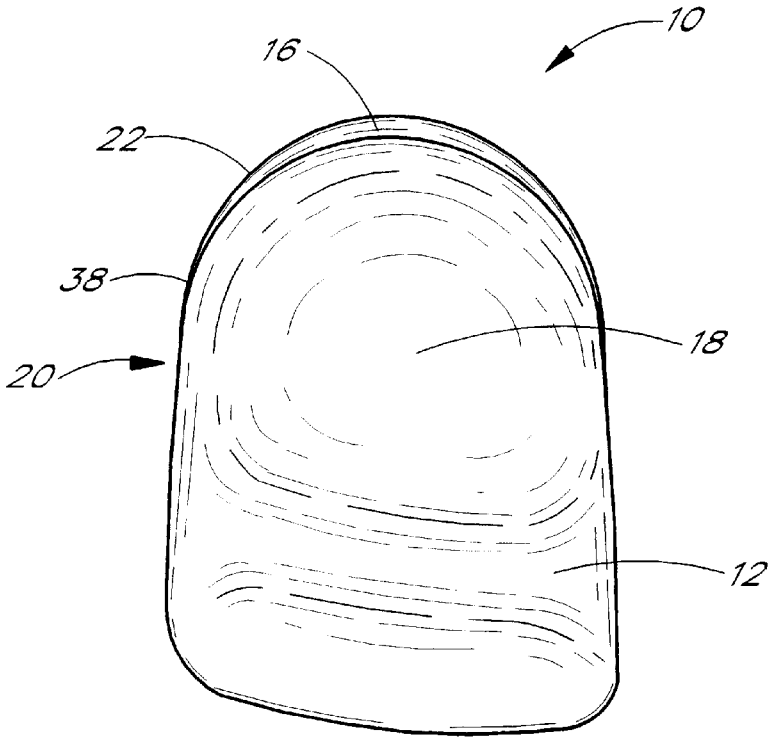
FIG. 2 is a top plan view of the orthotic heel cup of the present invention, including the Fasciitis bar.
Figure 3:
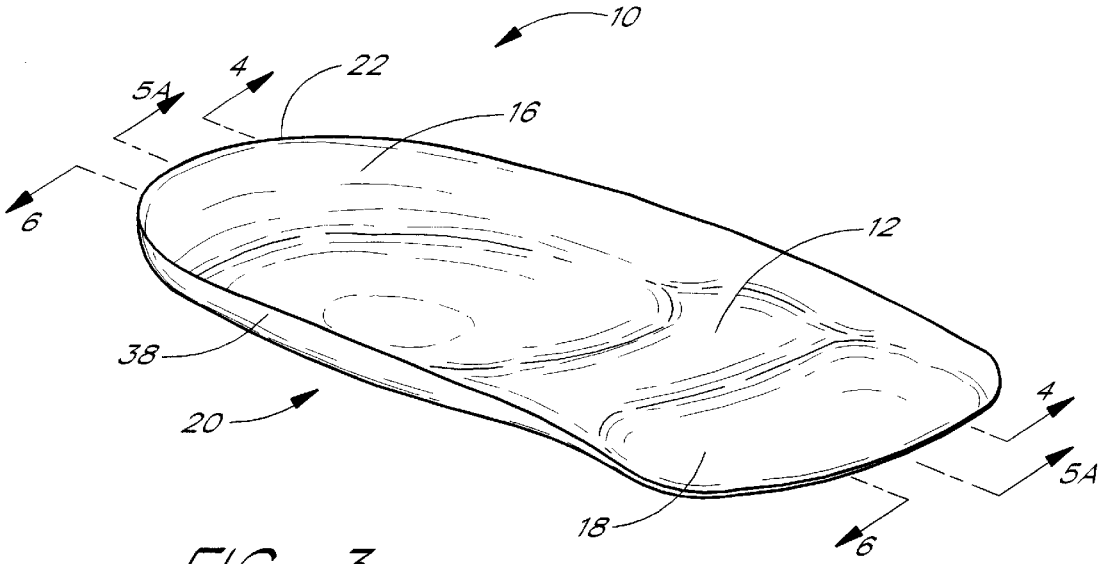
FIG. 3 is an isometric view of the orthotic heel cup with the Fasciitis bar.

FIG. 1 diagrammatically illustrates a typical human foot 24 along with the lower end of the tibia 11. This view shows the inside, or arch side, of the foot in outline, along with an outline of the major bones which would be seen on that side of a skeletal foot. Below the tibia 11 is the talus 13, or "ankle bone". Positioned below and rearwardly of the talus 13 is the calcaneus 26, or "heel bone". Positioned moderately below and forward of the talus 13 is the navicular 15. Immediately behind the navicular 15, and not shown in the illustration of FIG. 1, is the cuboid, which occupies a position similar to that of the navicular 15, but on the outside of the foot. The area between the calcaneus 26 and the navicular 15 and cuboid is the calcaneus-midtarsal connection 28 where the heel meets the arch of the foot 24.

Forward of the navicular 15 and cuboid are the cuneform bones 17. Extending forwardly from the cuneform bones 17 are the metatarsals 30 and the phalanges 32. Though not shown, the plantar fascia joins the calcaneus 26 to the MTP joints 34 between the metatarsals 30 and the phalanges 32, generally along the arch 36 of the foot 24.

Illustrated in FIGS. 2 through 6 is the orthotic device 10 in accordance with the present invention, provided to relieve pain in the heel of a person's foot 24 when worn. The orthotic device 10 is comprised of a cup-shaped heel portion 20 which is adapted to surround the heel and adjacent areas of a person's foot 24 when worn, and to properly position the orthotic device 10 beneath the patient's foot 24. The orthotic device 10, including the heel portion 20, is preferably formed as a single piece, and may comprise a material that can be manufactured in the illustrated configuration through thermo-forming or injection molding. Such materials include but are not limited to plastics, gels, foams such as P-lite® or polypropylene, visco-elastic polymer, Softsole®, polyurethane, and combinations thereof. Regardless of the material used, the preferred hardness is between 20 to 80 durometers. This hardness has been found to apply appropriate pressure to the patient's foot, without causing discomfort.

The orthotic device 10 includes a sole portion 18, having a bottom surface 40, which extends throughout the length of the orthotic device 10 and underlies the center of the patient's heel. Extending upwardly from this sole portion 18 is a rear wall portion 16, and side wall portions 38, which together form the heel cup portion 20. The rim 22 of the rear wall portion 16 and sidewall portions 38 is U-shaped to surround the rear of a patient's heel in a manner common to orthotics device of the prior art.

A raised bar-shaped portion 12, deemed the "Fasciitis bar", extends laterally across the orthotic device 10 just forward of the heel cup portion 20. The raised portion 12 preferably has a semi-cylindrical or pillow shape with tapered sides and extends above the sole portion 18 as a side-to-side bump. The Fasciitis bar 12 is preferably formed as one piece with the sole portion 18 and the heel cup portion 20, and is preferably constructed of the same material. As discussed above, such materials include but are not limited to plastics, gels, foams such as P-lite® or polypropylene, visco-elastic polymer, Softsole® sheets, polyurethane, and combinations thereof. Regardless of the hardness of the remainder of the orthotic device 10, the hardness of the Fasciitis bar 12 is preferably between 20 and 80 durometers to provide substantial, comfortable pressure against the sole of a patient's foot.

Figure 5A:
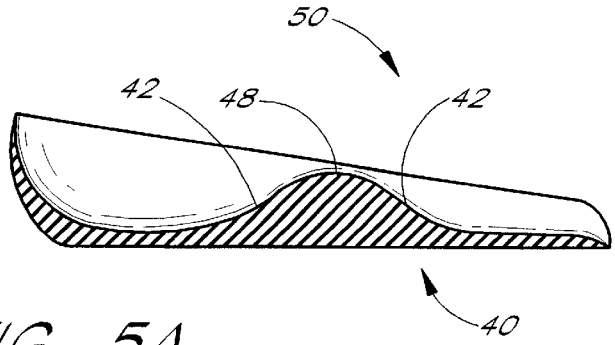
FIG. 5A is a sectional view of the orthotic heel cup taken along a line as shown in FIG. 3 which lies along the length of the orthotic device at the mid-point thereof which underlies the middle of the patient's foot.
Figure 5B:
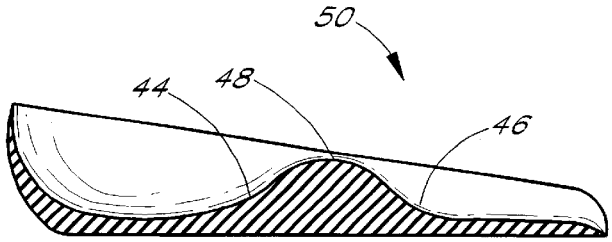
FIG. 5B is a sectional view similar to that of FIG. 5A showing an alternate embodiment of the orthotic heel cup.
Figure 4:
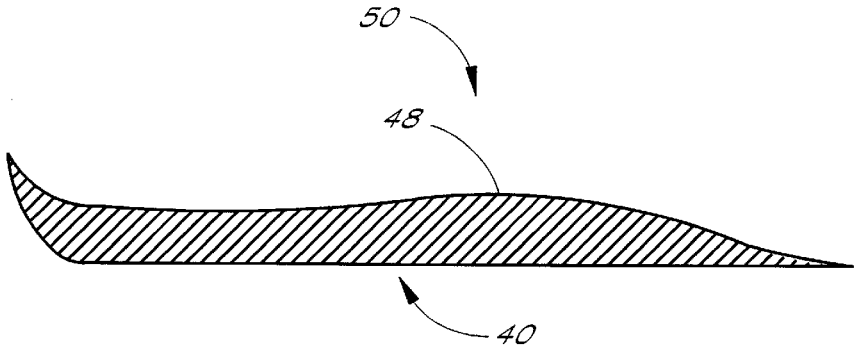
FIG. 4 is a sectional view of the orthotic heel cup taken along a line as shown in FIG. 3 which lies along the length of the orthotic device just inside the edge which underlies the inside (arch side) of the patient's foot.
Figure 6:
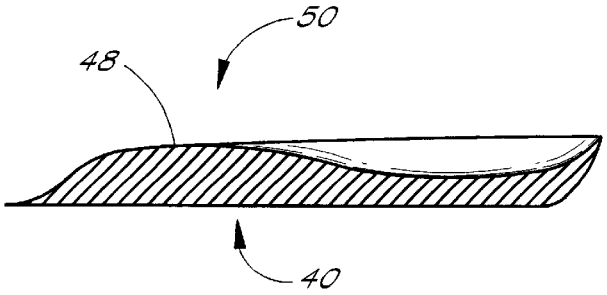
FIG. 6 is a sectional view of the orthotic heel cup of FIG. 3 taken along a line as shown in FIG. 3 which lies along the length of the orthotic device just inside the edge which underlies the outside of the patient's foot.

As shown in the cross sections of FIGS. 4, 5A and 6, the Fasciitis bar 12 extends laterally across the orthotic device 10, blending into the heel cup portion 20 at its extreme ends, but forming a substantial protuberance along the centerline of the orthotic device illustrated in FIG. 5A. The preferred thickness of the Fasciitis bar 12 at the lateral center portion 48 shown in FIG. 5A may range from 0.0625 inches to 0.375 inches. The length of the bar 12 may range from 0.5 to 2.5 inches, but is preferably centered about the centerline of the orthotic device. In the preferred embodiment shown in FIG. 5A, the Fasciitis bar 12 is generally symmetric from front-to-rear in cross section, with the front and rear surfaces sloping in similar contour. In a first alternate embodiment shown in FIG. 5B, the front surface 46 of the Fasciitis bar 12 slopes more acutely from the peak 48 of the bar 12 to provide a more abrupt pressure differential along the length of the patient's foot.

Figure 7:
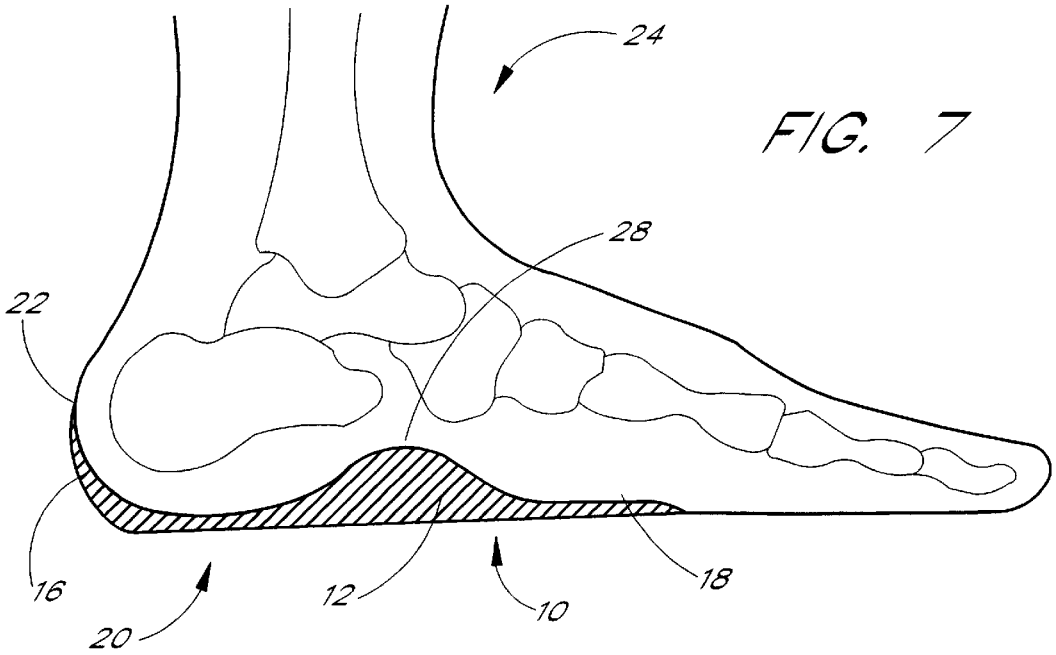
FIG. 7 is a side elevation view of a human left foot similar to the view of FIG. 1, including the major bones of the foot and ankle, along with a sectional view of the orthotic heel cup, in section, as shown in FIG. 5A, and illustrating the proper location of the orthotic heel cup and its Fasciitis bar.

FIG. 7 illustrates the orthotic device 10 properly sized and positioned in relation to a patient's foot 24. As shown, the raised portion or Fasciitis bar 12 is positioned by the heel cup portion 20 directly beneath the calcaneus-midtarsal connection 28 where the heel meets the arch of the foot 24, at the junction of the navicular 15 and cuboid with the calcaneus 28 (See FIG. 1). This placement provides moderate comfortable pressure on this area to provide significant heel pain relief. The bottom sole portion 18 may extend longitudinally forward along the sole of the patient's foot 24 and against the plantar fascia 36 (FIG. 1) as far forward on the foot 24 as desired, possibly even underlying the metatarsals 30 (FIG. 1).

Figure 8:
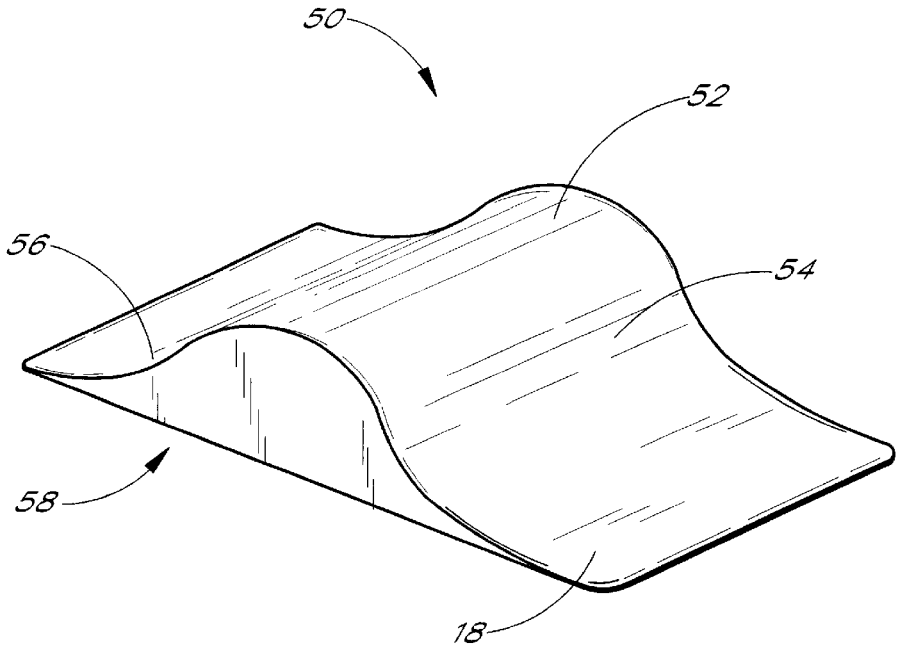
FIG. 8 is a perspective view of a second alternative embodiment of the orthotic device of the present invention.
Figure 9:
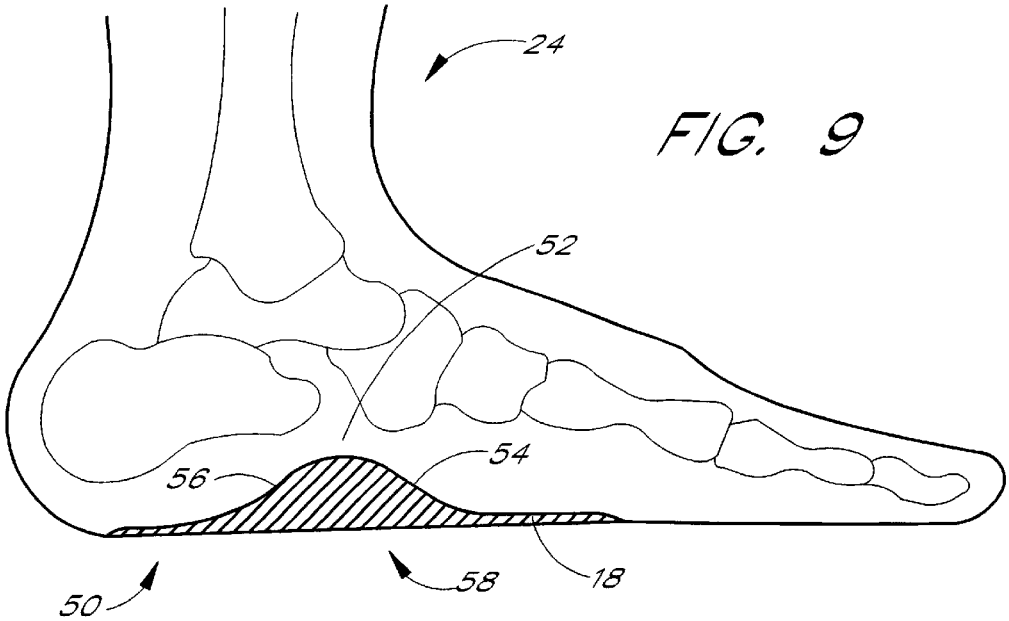
FIG. 9 is a view, similar to that of FIG. 7, but showing the second alternative embodiment of FIG. 8

Although the preceding description illustrates the Fasciitis bar 12 as a part of a heel cup orthotic device 10, FIGS. 8 and 9 illustrate a simpler form of the Fasciitis bar 50. In this form the Fasciitis bar 50 is a stand-alone member, providing a raised portion 52 having a semi-cylindrical shape with a flat bottom 58. The front portion 54 and back portion 56 of the bar 50 are tapered for increased comfort. In this form of the invention, the Fasciitis bar 50 may include adhesive on its flat side 58 for attachment to a shoe or another orthotic device. Alternatively, the upper surface 52, 54, 56 may include adhesive for attachment to the sole of a patient's foot. In either of these cases, the bar 50 is adhesively attached so that it underlies the calcaneus-midtarsal connection 28 where the heel meets the arch of the foot 24. While adhesive is described herein as the preferred method of attachment of this Fasciitis bar 50 to the sole of a person's foot or their shoe, strapping or clamping may also be used to hold the device in the proper location.

What is claimed is:

1. An orthotic device for treating Plantar Fasciitis in a person's foot, said orthotic device to be placed in an article of footwear comprising:

a heel portion sized to surround part of said heel of said foot; and a raised portion positioned with respect to said heel portion so that, when said heel portion surrounds said part of said heel of said foot, said raised portion is positioned to lie beneath and place localized pressure on the calcaneous-midtarsal connection of said foot, said raised portion sized so that, when said heel portion surrounds said part of said heel of said foot, and said raised portion is positioned to lie beneath the calcaneous-midtarsal connection of said foot, said raised portion extends a greater distance in a direction across the width of said foot than it does along the length of said foot wherein said orthotic device has a material hardness ranging from 20 to 80 using the durometer method.

2. An orthotic device for treating Plantar Fasciitis in a person's foot, said orthotic device to be placed in an article of footwear comprising:

a heel portion sized to surround part of said heel of said foot; and a raised portion positioned with respect to said heel portion so that when said heel portion surrounds said part of said heel of said foot, said raised portion is positioned to lie beneath and place localized pleasure on the calcaneous-midtarsal connection of said foot, said raised portion sized so that, when said heel portion surrounds said part of said heel of said foot, and said raised portion is positioned to lie beneath the calcaneous-midtarsal connection of said foot, said raised portion extends a greater distance in a direction across the width of said foot than it does along the length of said foot wherein said raised portion has a pillow shape and wherein the thickness of said pillow shaped portion is between 0.0625 inches and 0.375 inches.

3. An orthotic device for treating Plantar Fasciitis in a Person's foot, said orthotic device to be placed in an article of footwear comprising:

a heel portion sized to surround part of said heel of said foot; and a raised portion positioned with respect to said heel portion so that, when said heel portion surrounds said part of said heel of said foot, said raised portion is positioned to lie beneath and place localized pressure on the calcaneous-midtarsals connection of said foot, said raised portion sized so that, when said heel portion surrounds said part of said heel of said foot, and said raised portion is positioned to lie beneath the calcaneous-midtarsal connection of said foot, said raised portion extends a greater distance in a direction across the width of said foot than it does along the length of said foot wherein said raised portion has a pillow shape and wherein the length of said pillow shaped portion is between 0.5 and 2.5 inches.

4. An orthotic device for treating Plantar Fasciitis in a person's foot, said orthotic device to be placed in an article of footwear comprising:

a heel portion sized to surround part of said heel of said foot; and a raised portion positioned with respect to said heel portion so that, when said heel portion surrounds said part of said heel of said foot, said raised portion is positioned to lie beneath and place localized pressure on the calcaneous-midtarsal connection of said foot, said raised portion sized so that, when said heel portion surrounds said part of said heel of said foot, and said raised portion is positioned to lie beneath the calcaneous-midtarsal connection of said foot said raised portion extends a greater distance in a direction across the width of said foot than it does along the length of said foot wherein said raised portion has a pillow shape and wherein the slope of the side of said pillow-shaped raised portion furthest from said heel portion is greater than the slope of the side of said pillow-shaped raised portion closest to said heel portion.

* * * * *

UNITED STATES PATENT AND TRADEMARK OFFICE

CERTIFICATE OF CORRECTION

PATENT NO. : 6,315,786 B1
DATED : November 13, 2001
INVENTOR(S) : Arthur H. Smuckler It is certified that error appears in the above-identified patent and that said Letters Patent is hereby corrected as shown below:

Column 5,
Line 4, the word “pleasure” should be -- pressure --.
Line 25, the word “midtarsals” should be -- midtarsal --.

Signed and Sealed this

Twelfth Day of November, 2002

*Attest:*

*Attesting Officer*

JAMES E. ROGAN
*Director of the United States Patent and Trademark Office*